US010017860B2

(12) United States Patent
Smith et al.

(10) Patent No.: US 10,017,860 B2
(45) Date of Patent: Jul. 10, 2018

(54) METAL PLATED WEAR AND MOISTURE RESISTANT COMPOSITE ACTUATOR

(71) Applicant: Hamilton Sundstrand Corporation, Charlotte, NC (US)

(72) Inventors: Blair A. Smith, South Windsor, CT (US); Kevin M. Rankin, Windsor, CT (US); Ricardo O. Brown, West Hartford, CT (US); Jay W. Kokas, East Granby, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 602 days.

(21) Appl. No.: 14/183,617

(22) Filed: Feb. 19, 2014

(65) Prior Publication Data

US 2016/0186328 A1 Jun. 30, 2016

(51) Int. Cl.

| | |
|---|---|
| ***B32B 15/20*** | (2006.01) |
| ***C23C 18/38*** | (2006.01) |
| ***C25D 5/12*** | (2006.01) |
| ***C25D 7/00*** | (2006.01) |
| ***C23C 18/16*** | (2006.01) |
| ***C23C 18/20*** | (2006.01) |
| ***C23C 18/22*** | (2006.01) |

(52) U.S. Cl.

CPC ..... *C23C 18/38* (2013.01); *C23C 18/1633* (2013.01); *C23C 18/1653* (2013.01); *C23C 18/2013* (2013.01); *C23C 18/22* (2013.01); *C25D 5/12* (2013.01); *C25D 7/00* (2013.01)

(58) Field of Classification Search

None

See application file for complete search history.

(56) References Cited

U.S. PATENT DOCUMENTS

| | | | | |
|---|---|---|---|---|
| 3,892,883 | A | 7/1975 | Leclercq | |
| 3,915,809 | A * | 10/1975 | Wheatley | C23C 18/22 205/167 |
| 4,483,287 | A * | 11/1984 | Monigold | F02D 17/04 123/196 S |
| 4,552,626 | A | 11/1985 | Stevenson | |
| 4,815,940 | A | 3/1989 | Leshane et al. | |
| 2006/0060690 | A1 | 3/2006 | Aisenbrey | |
| 2006/0102487 | A1 * | 5/2006 | Parsons, II | C25D 7/00 205/183 |
| 2010/0304065 | A1 | 12/2010 | Tomantschger et al. | |
| 2010/0304182 | A1 * | 12/2010 | Facchini | B32B 15/013 428/652 |
| 2012/0053272 | A1 | 3/2012 | Burch et al. | |

FOREIGN PATENT DOCUMENTS

GB 1259841 * 1/1972

OTHER PUBLICATIONS

Extended European Search Report for Application No. 15155531.5-1359 dated Jul. 28, 2015; dated Aug. 4, 2015; 7 pages.

European Office Action Issued in EP Application No. 15155531.5, dated Apr. 9, 2018, 7 Pages.

* cited by examiner

*Primary Examiner* — Seth Dumbris

(74) *Attorney, Agent, or Firm* — Cantor Colburn LLP

(57) ABSTRACT

A component is provided including a body formed at least partially from a composite material. At least a portion of the composite material is covered by a plating. The plating includes a layer of electroless copper, a layer of electrolytic copper, a layer of nickel strike, and a finishing layer.

5 Claims, 4 Drawing Sheets

METAL PLATED WEAR AND MOISTURE RESISTANT COMPOSITE ACTUATOR

BACKGROUND OF THE INVENTION

This invention generally relates to components for use in an aircraft and, more particularly, to components formed of a composite material.

Typically aluminum or titanium actuators have been used in the aerospace industry to move movable components of an aircraft. For example, the gas turbine engines of an aircraft generally include a series of actuators that include, but are not limited to, actuators that move variable turbine vanes, engine nozzle geometry, air valves, and air blocking devices. The positions of these components are adjusted using appropriate actuators to control the characteristics of the engine during operation of the aircraft. These typical metal actuators are costly and add weight to the aircraft.

As with other aerospace components, there is a desire to reduce the cost and weight of engine mounted components, including engine mounted actuators. It is desirable that such engine mounted actuators and other components meet or exceed certain structural and wear properties and have the ability to survive in a high temperature environment. These requirements have typically driven designers away from the use of composite materials in aerospace applications. The properties of components formed from composite materials may be improved by plating the surface of such components. Chrome is commonly used as a plating material to improve the wear characteristics of a composite material component. However, chrome is a highly regulated material of concern and use of chrome is being phased out in the European Union within the next few years.

BRIEF DESCRIPTION OF THE INVENTION

According to one embodiment of the invention, a component is provided including a body formed at least partially from a composite material. At least a portion of the composite material is covered by plating. The plating includes a layer of electroless copper, a layer of electrolytic copper, a layer of nickel strike, and a finishing layer.

According to another embodiment of the invention, a method of plating at least a portion of a composite material component is provided including applying a layer of electroless copper to an exterior surface of the composite material component. A layer of electrolytic copper is applied to the exterior surface of the composite material component. A layer of nickel strike is applied to the exterior surface of the composite material component. A finishing layer is also applied to the exterior surface of the composite material component.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
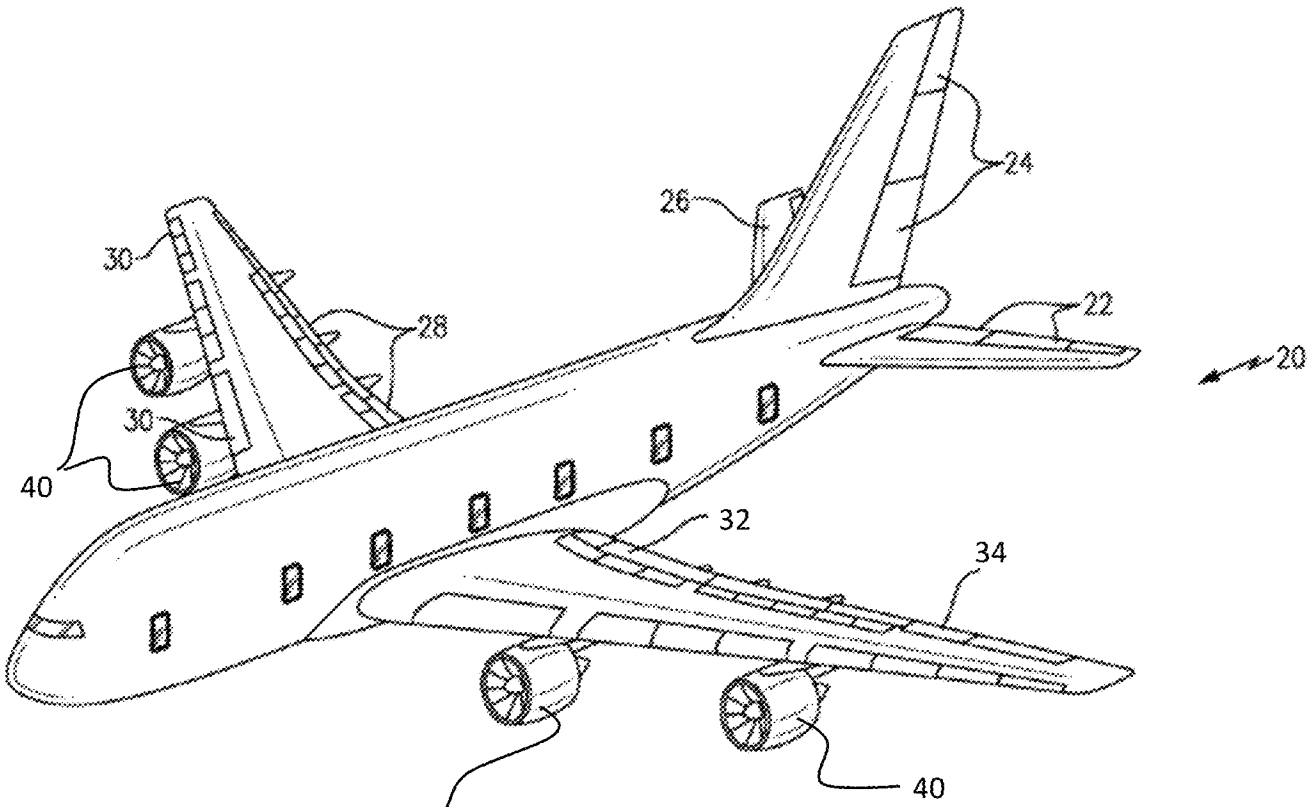
FIG. 1 is a schematic diagram of an aircraft.
Figure 2:
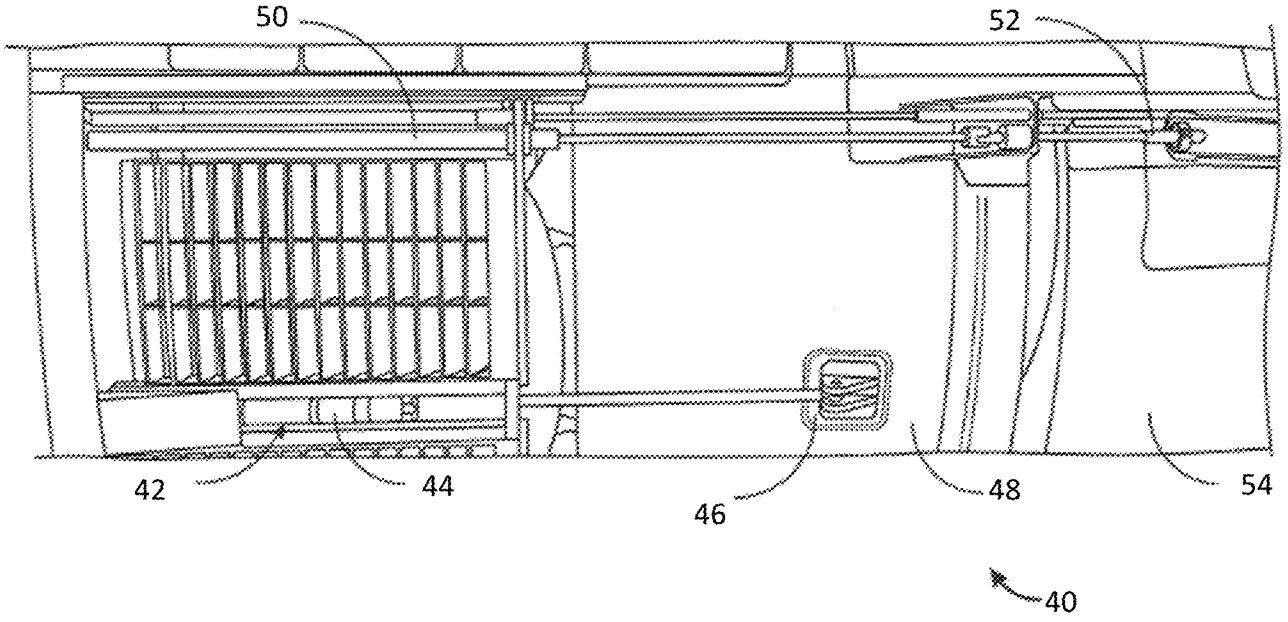
FIG. 2 is a side view of an engine of an aircraft having a conventional thrust reverser actuation system (TRAS) and a conventional variable area fan nozzle system (VAFN)

Referring now to FIG. 1, the illustrated aircraft 20, includes several movable components, such as elevators 22, rudders 24, horizontal stabilizers 26, flaps 28, slats 30, spoilers 32, and ailerons 34 for example. The position of each of these movable components is determined by a corresponding electromechanical or hydraulic actuator (not shown) to control the aerodynamic properties of the aircraft 20 during flight. The engines 40 of the aircraft 20 additionally include a plurality of movable components, such as turbine vanes and air valves for example. An actuator is coupled to each of the plurality of components and is configured to move each component between multiple positions respectively. For example, as illustrated in FIG. 2, disposed towards the bottom side of the engine 40 is a thrust reverser actuation system (TRAS) 42 having a hydraulic linear actuator 44 connected at an end 46 to a translatable TRAS cowl 48. The engine 40 also includes a variable area fan nozzle (VAFN) including a VAFN actuator 50 connected at an end 52 to a translatable VAFN cowl 54.

Figure 3:
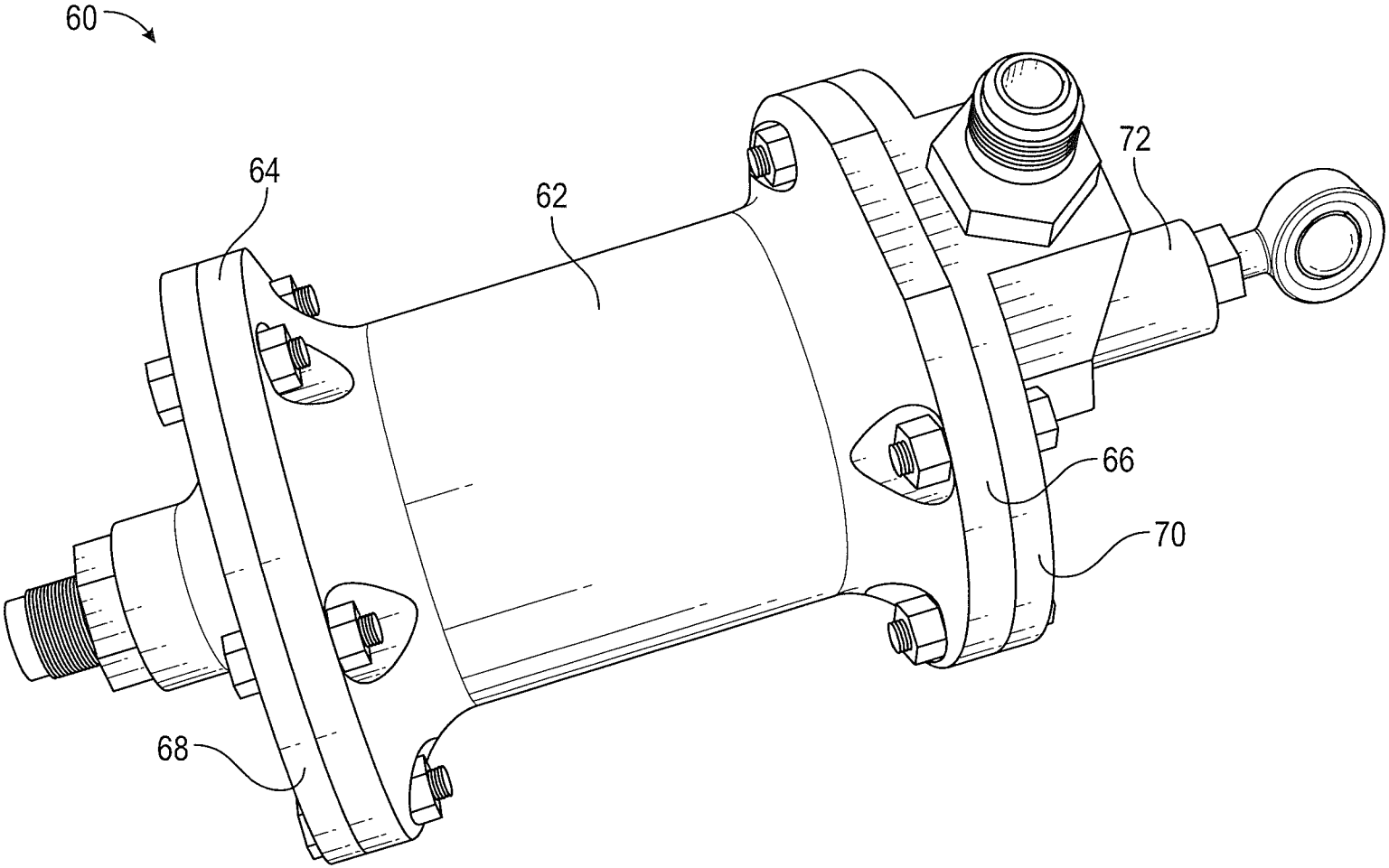
FIG. 3 is a perspective view of an actuator having one or more plated sub-components according to an embodiment of the invention.

Referring now to FIG. 3, an example of an engine mounted actuator 60 configured to move at least one of a plurality of movable components of an engine 40, such as actuator 44 or 50 for example, is illustrated in more detail. The actuator 60 generally includes a housing 62 having a first end cap 68 attached to a first end 64 of the housing 62 and a second end cap 70 attached to a second, opposite end 66 of the housing 62. Extending through one of the end caps 68, 70 is a piston rod 72 configured to move between a plurality of positions.

To reduce the weight of the aircraft, at least a portion of one or more of engine mounted components of the aircraft, such as the engine mounted actuators 60 for example, are formed from a composite material. In embodiments where only a portion of an actuator 60 is formed from a composite material, the portion may include one or more sub-components of the actuator 60, such as the housing 62, end caps 68, 70, and piston rod 72 for example. Alternatively, the entire actuator 60 may be formed from a composite material. In one embodiment, the composite material is a thermal plastic, including but not limited to polyamide-imide or polyetheretherketone (PEEK) for example. Each of the composite material actuator sub-components may be formed by a machining, thermoforming, compression molding or injection molding process.

Figure 4:
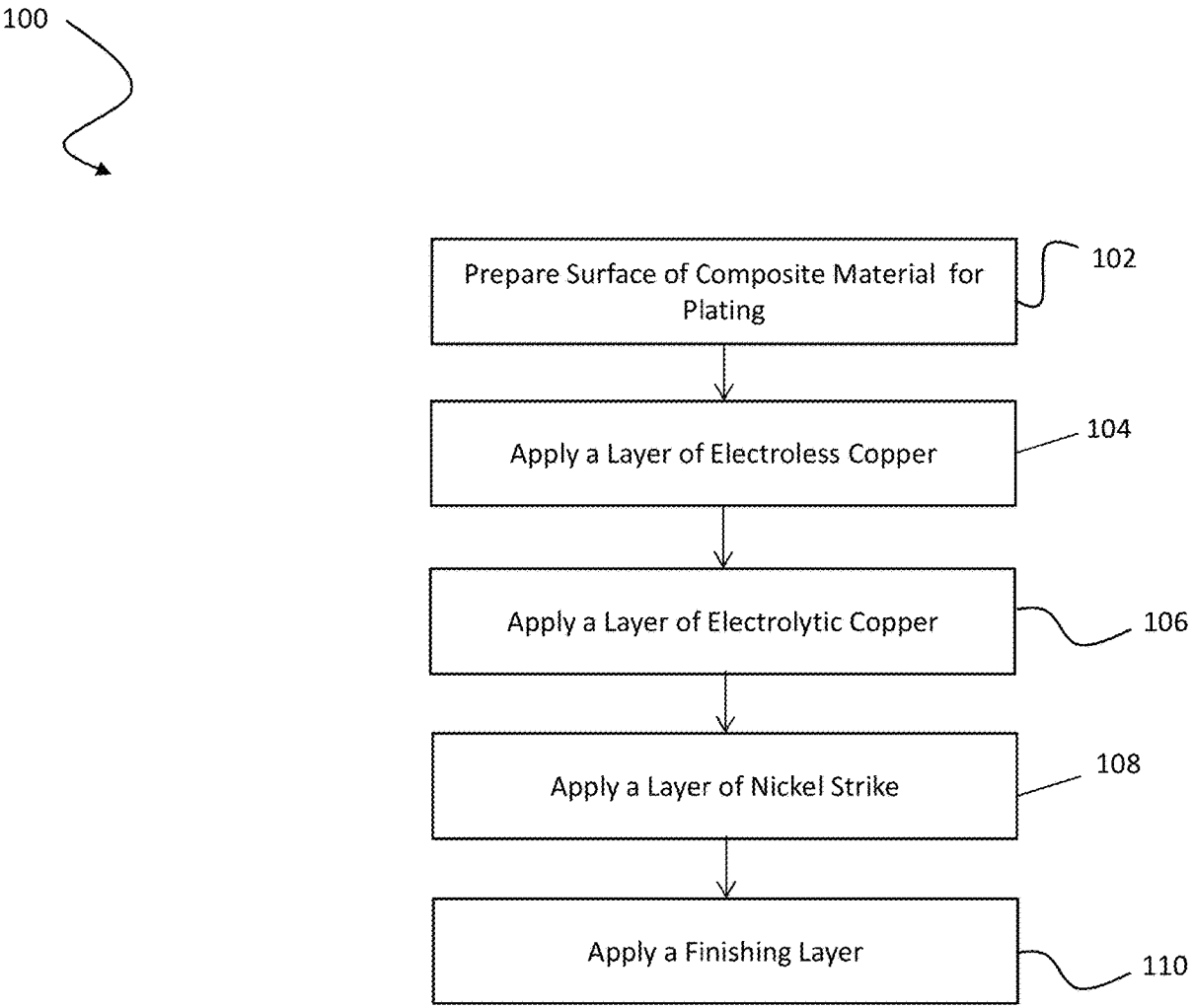
FIG. 4 is a schematic diagram of a process for plating a surface of a composite material actuator or sub-component according to an embodiment of the invention.

According to one embodiment, to achieve the minimum characteristics necessary for an aerospace application, such as wear resistance for example, at least one portion of the actuator 60 or other engine mounted components formed from a composite material are plated via a multi-layer plating process 100, illustrated in FIG. 4. Each composite material sub-component may be plated individually before being assembled to form the actuator 60.

In block 102, the surface of the composite material actuator or sub-component is prepared for plating. Preparation of the surface generally includes cleaning the surface with suitable solvent, such as isopropyl alcohol, acetone, methylisobutylketone, and ethanol for example. The surface of the composite material actuator or sub-component may additionally be roughened through a sand blasting or etching process to improve the adhesion between a subsequently added initial plating layer and the surface. The achieved surface roughness of the composite material actuator or sub-component will vary based on the grit size, the pressure, the distance of the nozzle from the surface, the angle of nozzle relative to the surface, or etching bath dwell time. In one embodiment, the grit size is in the range of about 80 to about 320, the pressure is between about 20 psi and about 60 psi. In addition, the distance of the nozzle from the surface may be between about 1 inch and about 4 inches and the angle of application may be between about 20 degrees and about 90 degrees.

In block 104, a layer of electroless copper is applied to the roughened surface of the composite material actuator or sub-component. The electroless copper may be applied using one of many processes, such as by submerging the actuator or sub-component in a bath, or by chemical vapor deposition or physical vapor deposition for example. In one embodiment, the layer of electroless copper has a substantially uniform thickness between about 0.00005 inches and about 0.0001 inches. An electrolytic copper layer is applied to the surface of the composite material actuator or sub-component, over the layer of electroless copper, in block 106. The electrolytic copper layer increases the thickness of copper formed over the composite material surface. In one embodiment, the electrolytic copper layer has a thickness between about 0.0015 inches and 0.002 inches and is configured to fill any voids in the adjacent electroless copper layer.

A layer of nickel strike is applied to the surface of the composite material actuator or sub-component in block 108. Exemplary types of nickel strike include Wood's nickel strike, Watt's nickel strike, and a sulfamate nickel strike for example. The layer of nickel strike is generally positioned over of the layer of electrolytic copper and has a thickness between about 0.00005 inches and about 0.0001 inches. For example, the layer of Wood's nickel strike is generally formed by submerging the actuator or sub-component in a nickel chloride bath. The nickel strike layer is corrosion resistant and acts as a barrier that prevents moisture from permeating through to the composite material.

In block 110, a finishing layer is applied to the surface of the actuator or sub-component, generally over the layer of nickel strike. The finishing layer has a minimum uniform thickness of about 0.001 inches and is configured to provide additional thickness to achieve the desired final dimensions of the actuator or sub-component. Because the finishing layer is generally configured to contact an adjacent component, the finishing layer is formed from a hard material, such as electroless nickel, chrome, cobalt-phosphorus, or another suitable material to provide wear resistance. In one embodiment, additives, such as Teflon, boron, silicon carbide, or chromium carbide for example, may be included to enhance the wear resistance of the finishing layer. A desired surface finish of the finishing layer may be achieved by polishing the surface of the composite material actuator or sub-component before application of the nickel strike layer. Although the actuators of the aircraft are described as being formed from a composite material, other components of the aircraft commonly formed from titanium, stainless steel, or any other metal may also be formed from a composite material and may be plated using the multi-step plating process 100.

By applying the plating process 100 to the engine mounted actuators, such as actuators 44, 50 for example, or other sub-components, the characteristics of the composite material surpass the minimum characteristics necessary for use in an aerospace application. Use of composite material components or sub-components significantly reduces not only the weight, but also the cost of the components.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An engine-mounted actuator for an aircraft comprising, a body formed at least partially from a thermal plastic material, a portion of the thermal plastic material being covered by a plating, the plating including a layer of electroless copper, a layer of electrolytic copper, a layer of nickel strike, and a finishing layer, the body comprising one of a housing, an endcap or a piston rod of the engine-mounted actuator, the layer of nickel strike having a thickness between 0.00005 inches and 0.0001 inches;

wherein the engine-mounted actuator is a hydraulic linear actuator of a thrust reverser actuation system.

2. The engine-mounted actuator according to claim 1, wherein the layer of electroless copper is arranged directly in contact with an exterior surface of the thermal plastic material.

3. The engine-mounted actuator according to claim 2, wherein the layer of electrolytic copper is positioned adjacent the layer of electroless copper.

4. The engine-mounted actuator according to claim 3, wherein the layer of nickel strike is positioned between the layer of electrolytic copper and the finishing layer.

5. The engine-mounted actuator according to claim 1, wherein the finishing layer includes an additive to enhance the wear resistance of the finishing layer.

* * * * *